US011039252B2

(12) United States Patent
Foglia et al.

(10) Patent No.: US 11,039,252 B2
(45) Date of Patent: Jun. 15, 2021

(54) MEMBRANE PLATE STRUCTURE FOR GENERATING SOUND WAVES

(71) Applicant: 4A Manufacturing GmbH, Traboch (AT)

(72) Inventors: Domenico Foglia, Vienna (AT); Michael Pichler, Kobenz (AT); Reinhard Hafellner, Spielberg (AT)

(73) Assignee: 4A Manufacturing GmbH, Traboch (AT)

( * ) Notice: Subject to any disclaimer, the term of this patent is extended or adjusted under 35 U.S.C. 154(b) by 0 days.

(21) Appl. No.: 16/098,097

(22) PCT Filed: May 3, 2017

(86) PCT No.: PCT/EP2017/060590

§ 371 (c)(1),
(2) Date: Oct. 31, 2018

(87) PCT Pub. No.: WO2017/191226

PCT Pub. Date: Nov. 9, 2017

(65) Prior Publication Data

US 2019/0306627 A1 Oct. 3, 2019

(30) Foreign Application Priority Data

May 3, 2016 (GB) ..... 1607700

(51) Int. Cl.
*H04R 7/10* (2006.01)
*H04R 7/16* (2006.01)
(Continued)

(52) U.S. Cl.
CPC ..... *H04R 7/10* (2013.01); *H04R 7/16* (2013.01); *H04R 9/06* (2013.01); *H04R 31/003* (2013.01); *H04R 2307/023* (2013.01)

(58) Field of Classification Search
CPC . H04R 7/04; H04R 7/045; H04R 7/06; H04R 7/10; H04R 7/122; H04R 31/003;
(Continued)

(56) References Cited

U.S. PATENT DOCUMENTS 3,535,291 A 10/1970 Riemhofer et al.
3,930,130 A * 12/1975 Boszor ..... H04R 7/02 181/169

(Continued)

FOREIGN PATENT DOCUMENTS

CN 102144081 3/2010
CN 204707266 10/2015

(Continued)

OTHER PUBLICATIONS

International Search Report for PCT/EP2014/060713, dated Jul. 16, 2014 (11 pages).

(Continued)

*Primary Examiner* — Alexander Krzystan
*Assistant Examiner* — Julie X Dang
(74) *Attorney, Agent, or Firm* — Indiano Law Group LLC; E. Victor Indiano; John T. Woods, III

(57) ABSTRACT

The present invention relates to a membrane plate structure for generating sound waves, the membrane plate structure comprises a vibrating element for generating sound waves and a membrane plate which is coupleable to the vibrating element. The membrane plate has a different width with respect to its length, wherein the width is shorter than the length. The membrane plate comprises an UD layer made of fibers, wherein the fibers of the UD layer are oriented along the width of the membrane plate.

18 Claims, 4 Drawing Sheets

(51) Int. Cl.
*H04R 9/06* (2006.01)
*H04R 31/00* (2006.01)

(58) Field of Classification Search
CPC .... H04R 7/125; H04R 2307/025; H04R 9/06; H04R 2307/027; H04R 7/02; H04R 1/22; H04R 2499/11; H04R 9/025
USPC ..... 181/168, 169, 170; 381/426, 427, 428, 381/431
See application file for complete search history.

(56) References Cited

U.S. PATENT DOCUMENTS 4,517,416 A 5/1985 Goossens
5,701,359 A * 12/1997 Guenther ..... H04R 7/06 181/157
6,097,829 A * 8/2000 Guenther ..... H04R 7/06 381/425
6,332,029 B1 12/2001 Azima et al.
6,694,038 B1 2/2004 Azima
7,807,266 B2 10/2010 Reindl
9,485,581 B2 11/2016 Huang
10,028,060 B2 * 7/2018 Foglia ..... H04R 7/125
10,034,093 B2 * 7/2018 Foglia ..... B32B 3/28
2002/0146145 A1 10/2002 James et al.
2003/0170460 A1 3/2003 Sienkiewicz et al.
2004/0071977 A1 4/2004 Shah
2004/0247152 A1 12/2004 Greb et al.
2007/0148434 A1 6/2007 Miller et al.
2007/0190881 A1 * 8/2007 Shibaoka ..... H04R 1/06 442/228
2010/0135519 A1 6/2010 Werners et al.
2011/0104506 A1 5/2011 Behl et al.
2011/0159247 A1 6/2011 Sugimoto et al.
2011/0159261 A1 6/2011 Sugimoto et al.
2011/0272208 A1 11/2011 Shen
2011/0299716 A1 12/2011 Reckert
2012/0093353 A1 * 4/2012 Windischberger ... H04R 31/003 381/396
2012/0171466 A1 7/2012 Urbach et al.
2012/0189838 A1 7/2012 Pellacani et al.
2012/0250930 A1 * 10/2012 Kajihara ..... H04R 7/12 381/412
2013/0016874 A1 1/2013 Huang et al.
2013/0087407 A1 * 4/2013 McKnight ..... G10K 11/172 181/287
2013/0089224 A1 * 4/2013 Dehe ..... H04R 7/04 381/191
2013/0280479 A1 * 10/2013 Okada ..... B32B 5/26 428/114
2015/0181340 A1 6/2015 Noda
2015/0195655 A1 * 7/2015 Fan ..... H04R 9/047 381/400
2015/0204065 A1 7/2015 Lotti et al.
2016/0142823 A1 * 5/2016 So ..... H04R 7/125 181/165
2016/0309260 A1 * 10/2016 Bohm ..... H04R 7/10

FOREIGN PATENT DOCUMENTS

DE 3705937 A1 9/1988
DE 10257396 A1 6/2004
DE 10340541 A1 3/2005
DE 102006056612 A1 5/2007
DE 102013225665 5/2007
EP 0082 086 A1 6/1983
EP 1 276 348 A1 1/2003
EP WO 2010/095351 A1 8/2010
EP 2500123 A2 9/2012
EP 2562324 A1 2/2013
EP 3086570 A1 * 10/2016 ..... H04R 7/02
FR 2878609 A1 6/2006
FR 3 028 704 5/2016
JP 62193398 8/1987
JP 62193398 A * 8/1987
JP 2010-193352 9/2010
KR 20130047249 5/2013
WO WO 2005042239 A2 5/2005
WO WO-2011015439 A1 * 2/2011 ..... B01D 71/56
WO WO2014/106713 A1 7/2014

OTHER PUBLICATIONS

Translation of DE 102006056612-A1.
PCT ISA Written Opinion re application PCT/EP2017/060590 ~dated Jul. 12, 2017.
UK Intellectual Property Office, Patents Act of 1977, Search Report under Section 17(5); dated Jun. 23, 2016.
European Patent Office; Patent Translation of Description of Guyot European patent Applicaiton EP0082086.
International Search Report of the European Patent Office for the instant application, No. PCT/EP2017/060590 dated Jul. 12, 2017.
International Search Report for PCT/EP2017/058694, dated Sep. 23, 2019 (6 pages).
Translation of JP58182996.

* cited by examiner

MEMBRANE PLATE STRUCTURE FOR GENERATING SOUND WAVES

FIELD OF INVENTION

The present invention relates to a membrane plate structure for generating sound waves and to a loudspeaker comprising the membrane plate structure.

ART BACKGROUND

Loudspeaker, in particular in micro-speakers for portable devices (mobile phones), and more in particular receiver micro-speaker (also called ear-pieces, responsible for the voice sound-transmission), needs thin elements in order to reduce the overall size of the loudspeaker. In general, a loudspeaker comprises a diaphragm which is excited by a coil or another vibrating element.

In US 2013/0016874 A1 for example this function is represented by the element 121 of a diaphragm 12 which guarantees high break-up frequency and low weight. This element is often called membrane plate, to be distinguished from the surround (connecting area 123) which is often called membrane. The characteristics required by a membrane plate are:

a. High material resonance frequency—to guarantee a linearity and the absence of acoustic peaks in the hearable region
b. Low weight—to reduce the moved mass and consequently increase the sound pressure level and the efficiency of the speaker
c. High temperature resistance—to guarantee the same mechanical stiffness at higher working temperatures The resonance frequency of a material is directly proportional to its length and width and a figure of merit, here defined "Frequency Factor". The frequency factor is defined as follow:

$$d\sqrt{\frac{B}{\rho}}$$

Where d, is the total thickness, B is the bending module, and ρ is the density of the membrane plate material. The square root is also the speed of sound of the material.

The break-up frequencies of a (micro-) loudspeaker are dependent from the mechanical system formed by the coil and the membrane plate. Some break-up modes are partially dependent from the coil mechanical properties (here defined as coil modes), some other are dependent only from the membrane plate properties (here defined as plate modes). The membrane plate mechanical properties are strongly affecting also the coil modes.

In micro-speakers, due to very small available thickness, the membrane plates are generally having a total thickness lower than 500 μm.

For this applications, due to the low available thickness, in order to achieve high frequency factors, it is necessary to utilize high mechanical performance materials. Sandwich constructions represent in general the best solution for this application, since they offer the best ratio of bending module to weight (see also "An Introduction to Sandwich Construction", Zenkert, D., 1995, Engineering Materials Advisory Services Ltd).

For these reasons, in micro-speaker applications, the actual state of the art is the use of a flat (or nearly flat) sandwich composite membrane plates, where the skin layers are aluminum foils between 8 and 20 μm, and the core layer is a very thin foam layer between 100 and 400 μm (disclosed for example in CN 204707266 U). The total weight of this sandwich oscillates normally between 80 and 160 g/m$^2$.

The market is continuously looking for technical solutions which could improve the frequency factor at thicknesses lower than 500 μm and weight under 160 g/m$^2$.

For some applications the market is looking for non-conductive materials.

Fiber reinforced composites are offering very high ratio of stiffness to weight among the all available materials. The characteristics of their unidirectional (UD) tape is to offer extremely high stiffness in the fiber direction, and very low stiffness in the perpendicular direction. To solve this problem, normally a multiple ply (0/90° or 30°/30°, etc) of UD tapes is formed, which has an improved anisotropy (in the direction of the plies), but its stiffness in both directions is lower since only one ply is contributing to the stiffness of its UD direction.

Example in table 1.

TABLE 1

| Material | Young Modulus in fiber direction [GPa] | Young Modulus perpendicular to fiber direction [GPa] | Density [g/cm$^3$] | Thickness [μm] | Area Density [g/m$^2$] |
|---|---|---|---|---|---|
| UD Aramid | 85 | 4.5 | 1.33 | 150 | 200 |
| 0/90° Aramid Ply | 45 | 45 | 1.33 | 300 | 400 |

Multiply fiber composites are very well known in the loudspeaker industry as diaphragm material thanks to their very high speed of sound. Their usual applications are as simple multi-ply (0/90°) or as skin layers of sandwich construction of a total thickness higher than 2 mm, like the construction indicated in U.S. Pat. No. 5,701,359A.

SUMMARY OF THE INVENTION

There may be a need to provide a component for a loudspeaker with very small space requirements (micro-speaker)

According to a first aspect of the present invention, a membrane plate structure comprising a membrane plate is attachable to a coil or another vibrating element for generating sound waves is presented. The membrane plate comprises at least one layer of thin UD (Uni Directional) fiber tape. In an exemplary embodiment, the fibers are oriented along the direction of the shorter size of the membrane plate geometry (FIG. 2).

The fibers, i.e. the fiber tape, used for the membrane plate according to the present invention, may be formed of a polymer matrix reinforced by fibers. The membrane plate is made of plastic as a matrix material, in particular a thermoplastic plastic, a thermoset plastic or an elastomer plastic.

According to an exemplary embodiment of the present invention, the membrane plate has a different width with respect to its length (for example, the membrane plate has a rectangular form). The width is shorter than the length. The fibers of the UD layer are oriented along a fiber direction having an angle between approx. −30° and approx. +30°, in particular between approx. −15° and approx. +15°, more in particular approx. 5° and approx. +5°, with respect to the width (direction) of the membrane plate. Specifically, the fiber direction may be parallel to the width (direction) of the membrane plate. The membrane plate has a different width with respect to its length, wherein the width is shorter than the length. The width (direction) is defined as the shortest distance between opposing edges of the membrane plate.

In rectangular (micro-) loudspeakers according to the present invention, a thin UD tape displaced as membrane plate material with the fibers directed in the shorter (width) direction of the plate has a higher break-up mode than if directed toward the longer (length) direction of the plate.

This effect is shown both in simulations and in real measurements.

Main advantages of using a Fiber UD Tape along the shorter size of the membrane plate are:

- Possibility of creating membrane plate materials with speed of sound higher than aluminum (up to 20 times higher)
- Possibility of creating low weight plate materials lower than 160 g/m$^2$
- Possibility of creating sandwich materials with fiber UD tape as skin layers with total weight lower than 160 g/m$^2$
- Possibility to increase the break-up frequency of a micro-speaker compared to a state of the art material (sandwich with aluminum as skin layers)
- Possibility to reduce the thickness and/or the weight of the membrane plate obtaining the same break-up frequency of a state of the art material (sandwich with aluminum as skin layers).
- Possibility of creating non-conductive high performance membrane plates.

Drawbacks of these materials are their high total mass, which is making them in general suitable only for woofer or sub-woofer, and their anisotropy outside the UD directions.

Unidirectional fiber-reinforced materials are not used in normal speakers due to their similar size of the length and width (mostly round) and their dimension (normally larger than 30 mm).

In micro-speaker application the utilization of a multi-ply is not effective since normally they are available only at masses over 200 g/m$^2$. Moreover, even if they would be available, at the same mass their frequency factor would be worse than the one of aluminum sandwich (CIMERA ADR120-8H) (see table 2)

TABLE 2

| | Thickness [μm] | Bending Modulus [Gpa] | Density [kg/m$^3$] | Area density [g/m$^2$] | Frequency Factor [m$^2$/s] |
|---|---|---|---|---|---|
| 0°/90° Aramid Multiply | 59 | 45 | 1350 | 80 | 0.34 |
| 0°/90° HM Carbon Multiply | 50 | 135 | 1500 | 80 | 0.46 |
| CIMERA ADR120-8H | 120 | 25 | 800 | 80 | 0.67 |

A very important characteristic of micro-speakers is their rectangular form, which allows the best use of space. This form is causing also the utilization of rectangular membrane plates.

According to further embodiment of the present invention, the membrane plate material is constituted by two skin layers made of thin UD tape, and a core layer, constituting a sandwich structure. The UD skin layers are both parallel and directed along the shorter size of the plate.

A thin fiber UD tape is defined as a fiber reinforced plastic tape with an area density comprised between 5 and 100 g/m$^2$.

According to a further embodiment of the present invention, the core layer of the sandwich structure is a material which is free of pores (e.g. free of pores having a size larger 1 μm) and act as binding elements between the two skin layers.

According to a further embodiment of the present invention, the core layer is a porous material, like a foam or a honeycomb. Usual structural foam can include polyester foams, polyurethane foams, polysulfonic foams, polyvinylchloride foams, PMI foams, etc.

According to a further embodiment of the present invention, the core layer is a fiber UD tape perpendicular to the direction of the fiber UD tape of the skin layers.

According to an exemplary embodiment, the plate material has a HDT (heat deflection temperature) higher than 80° C., in particular higher than 130° C., further in particular higher than 180° C. measured along the fiber direction.

According to an exemplary embodiment, the plate material maintains its geometrical dimensions (change in size lower than 5%) under temperatures higher than 130° C., higher than 180° C. and higher than 220° C.

According to an exemplary embodiment, the plate material is suitable as insert for an insert molding process.

According to an exemplary embodiment, the membrane plate material is characterized by having an area density lower than 200 g/m$^2$, preferable lower than 160 g/m$^2$, further in particular lower than 120 g/m$^2$.

According to an exemplary embodiment, the membrane plate material is characterized by having a total thickness lower than 500 μm.

According to an exemplary embodiment, the fiber UD tape material is constituted by materials which are non-conductive. The non-conductive fibers can be constituted by polymer fibers such as LCPs (liquid crystal polymer), aramides, PBO (Zylon fibres), UHMWPE (Ultra-high-molecular-weight polyethylene) and/or ceramic fibers. The plastic which is reinforced by the fibers can be a thermoplastic plastic, a thermoset plastic or an elastomer plastic.

According to an exemplary embodiment, the fiber UD tape material is constituted by carbon based fibers. These fibers can be high strength, intermediate modulus, high modulus, ultra high modulus and pitch fibers (Young modulus higher than 600 GPa).

According to an exemplary embodiment, the UD fiber skin layer of the sandwich construction are characterized by an area density lower than 50 g/m$^2$, better lower than 40 g/m$^2$, at best lower than 30 g/m$^2$ for each skin layer.

According to an exemplary embodiment, the membrane plate structure extend within a plane. In other words, the membrane plate structure has a flat, uncurved shape extending along the plane.

According to an exemplary embodiment, the membrane plate structure comprises a curved, wavelike, or dished (trapezoid) like, or dome like or conus like structure and runs not within a plane.

According to an exemplary embodiment, the membrane plate structure form has a total depth of less than 1/5, in particular 1/10, further in particular 1/20, of a largest width of the stack.

According to an exemplary embodiment, the multi-layer material can be produced through a cold lamination process.

According to an exemplary embodiment, the multi-layer material can be produced through a lamination process of thermoplastic core between two skin layers, at a temperature higher than the melting point of the core layer and lower than then the melting point of the skin layer.

According to an exemplary embodiment, the multi-layer material can be produced with the application of a resin on one skin layer, the covering of the resin with second skin layer, and the curing of the resin.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

Examples and Comparison

Examples are shown in the table 3:

| | Thickness [μm] | Bending Modulus [Gpa] | Density [kg/m$^3$] | Area density [g/m$^2$] | Frequency Factor [m$^2$/s] |
|---|---|---|---|---|---|
| CIMERA TDR220-35 (UD Aramid skin layers) | 220 | 50 | 680 | 150 | 1.89 |
| CIMERA CDR220-15 (UD HM Carbon skin layers) | 220 | 80 | 470 | 103 | 2.87 |
| CIMERA ADR220-12H (Aluminum skin layers) | 220 | 18 | 540 | 119 | 1.27 |

A sandwich construction with foam as core layer with UD fiber tapes as skin layers (CIMERA TDR or CDR) strongly outperforms the sandwich construction with aluminum skin layers (CIMERA ADR).

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION OF EXEMPLARY EMBODIMENTS

Figure 1:
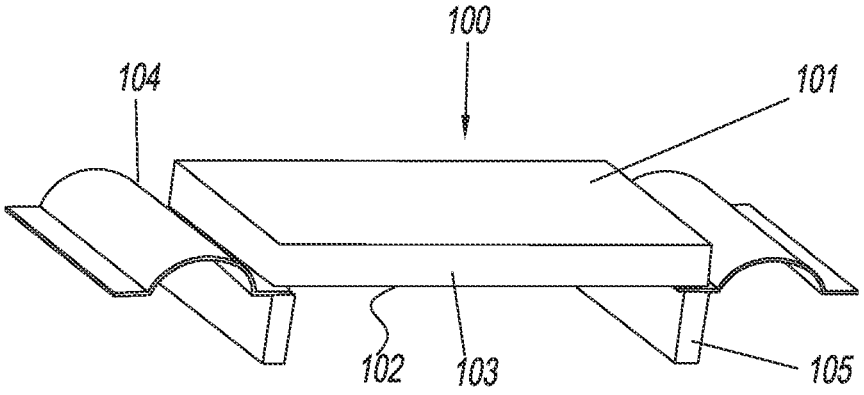
FIG. 1 shows a schematic view of a loudspeaker comprising the membrane plate structure with aluminum as skin layer.

The illustrations in the drawings are schematic. It is noted that in different figures similar or identical elements are provided with the same reference signs.

FIG. 1 shows a schematic view of a loudspeaker comprising a membrane plate structure. The membrane plate structure comprises a carrier element 104, a coil 105 which is coupled to the carrier element 104 and a membrane plate 100. The membrane plate 100 is supported by the carrier element 104 such that the membrane plate 100 is excitable by the coil 105 for generating sound waves.

The membrane plate structure comprises a membrane plate 100 having a first skin layer 101, a second skin layer 102 and a core layer 103 which is interposed between the first skin layer 101 and the second skin layer 102.

The coil 105 may be electrically excited by a control unit (not shown). The membrane plate 100 is coupled to the coil 105 such that the excited coil 105 excites the membrane plate 100 as well. The membrane plate 100 vibrates in an excited state and thereby generates acoustic sound.

The first skin layer 101, the second skin layer 102 and the core layer 103 form a stack extending within a plane. In other words, the membrane plate 100 has a flat, uncurved shape extending along the plane. More specifically, the first skin layer 101, the second skin layer 102 and the core layer 103 extend along respective planes having parallel plane normals. In this specific example, the first skin layer 101 and the second skin layer 102 are made of aluminium.

Figure 2:
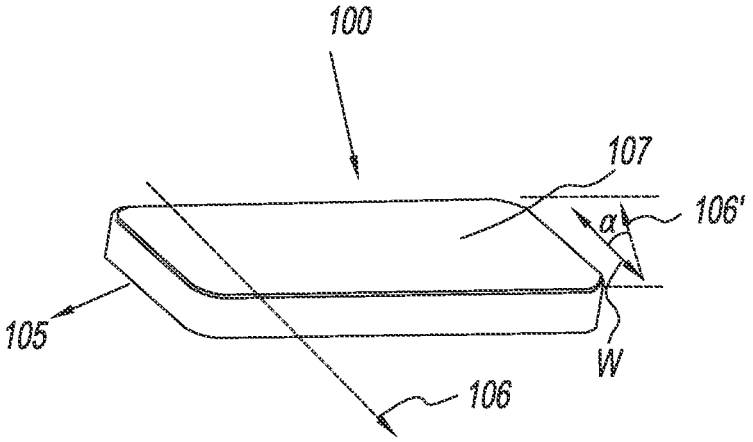
FIG. 2 shows the coil and membrane plate of a loudspeaker comprising the membrane plate structure according to an exemplary embodiment of the present invention, wherein the fibers are oriented along the shorter (width) size of the plate.

FIG. 2 shows an exemplary embodiment of the present invention, wherein the membrane plate structure comprises a vibrating element 105 and a membrane plate 100, which is coupleable to the vibrating element 105 for generating sound waves. The membrane plate 100 has a different width w with respect to its length, wherein the width w is shorter than the length. In particular, the width w is defined as the shortest distance between opposing edges of the membrane plate 100. The membrane plate 100 comprises an UD layer made of fibers 107, wherein the fibers of the UD layer 107 are oriented along the width w of the membrane plate 100 (indicated with fiber direction 106). The fibres may also be orientated along a further fiber direction 106' which has an angle $\alpha$ with respect to the width direction w of the membrane plate 100. The angle $\alpha$ may be between −30° and +30°.

The membrane plate 100 may consist of a matrix made of plastic or epoxy resin, in which fibers, in particular uni directional (UD) fibers 107 are integrated. UD fibres 107 extends along the fiber direction 106. The fiber direction 106 is parallel to a width w direction of the membrane plate 100. As can be taken from FIG. 2, the membrane plate 100 is formed rectangular, wherein the membrane plate 100 has a length and a with extension. The fibers 107 extends along the fiber direction 106 which is parallel to the width w direction of the membrane plate.

Furthermore, it is shown in FIG. 2 that the coil 105 surrounds circumferentially the membrane plate 100. Hence, a proper control and excitation of the membrane plate 100 is possible.

Figure 3:
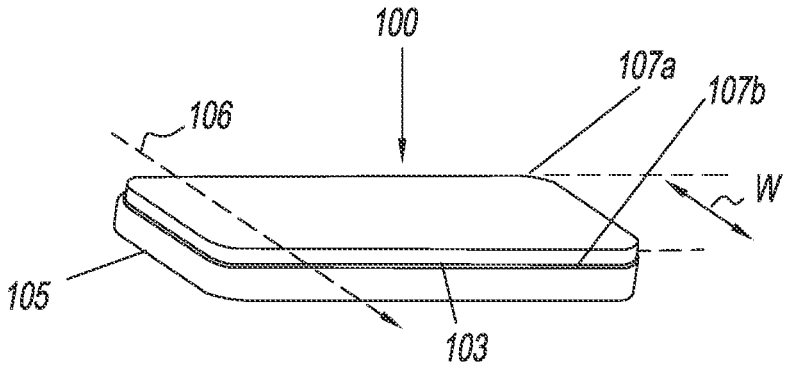
FIG. 3 shows the coil and membrane plate of a loudspeaker comprising the membrane plate structure according to an exemplary embodiment of the present invention, wherein the fibers UD skin layers are oriented along the shorter (width) size of the plate and the core layer is free of pores.

FIG. 3 shows a membrane structure according to an exemplary embodiment of the present invention, wherein the membrane plate 100 is formed in a sandwich design. The plate 100 comprises a first skin layer 107*a* and a second skin layer 107*b*, wherein a core layer 103 is interposed between both skin layers 101, 102. A young modulus of the core layer 103 may be lower than the young modulus of the first skin layer 101 and the second skin layer 102. The first skin layer 107*a*, the second skin layer 107*b* and/or the core layer 103 may be made of a fiber UD tape.

Figure 4:
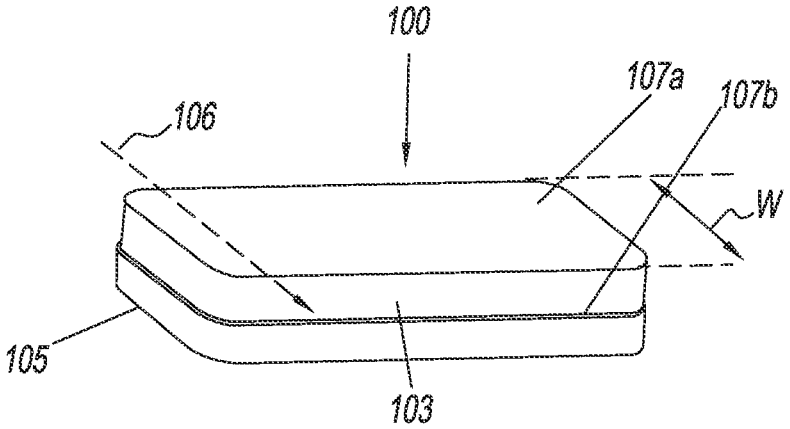
FIG. 4 shows the coil and membrane plate of a loudspeaker comprising the membrane plate structure according to an exemplary embodiment of the present invention, wherein the fibers UD skin layers are oriented along the shorter (width) size of the plate and the core layer is porous.

FIG. 4 shows a further exemplary embodiment of the present invention, wherein the membrane plate 100 comprises a sandwich design according to the embodiment shown in FIG. 3. Furthermore, the core layer 103 is made of a foam material. The foam material may be a plastic material comprising pores filled with gas, such as air, wherein the pore size is for example 5 μm to 300 μm (Micrometer), in particular 10 μm to 200 μm, more in particular 30 μm to 150 μm.

Figure 5:
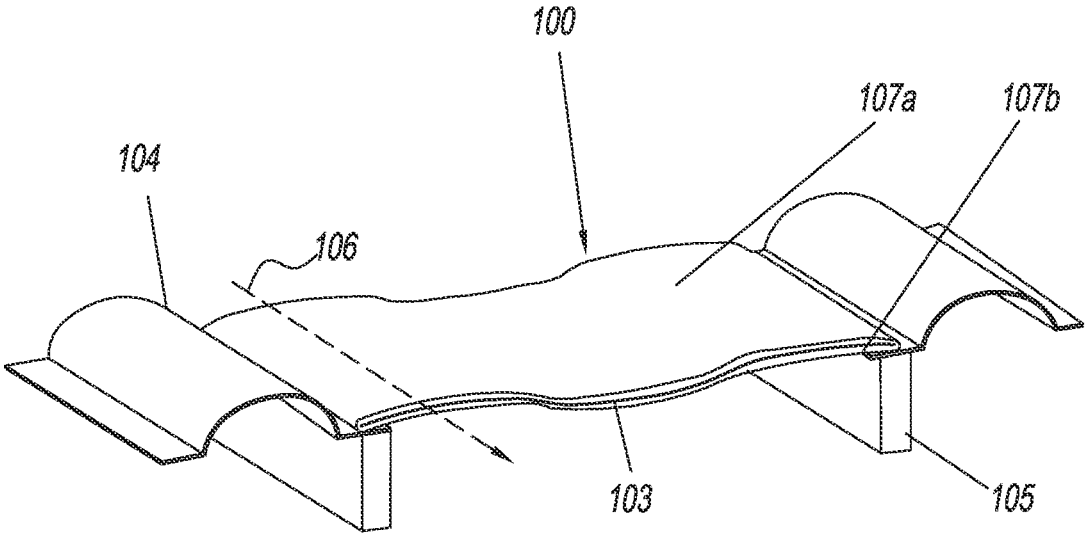
FIG. 5 shows a curved design of a membrane plate structure, according to an exemplary embodiment of the present invention.

FIG. 5 shows an exemplary embodiment of a membrane plate structure wherein the membrane plate 100 is formed in a sandwich design. The plate 100 comprises a first skin layer 107*a* and a second skin layer 107*b*, wherein a core layer 103 is interposed between both skin layers 107*a* and 107*b*. In particular, the first skin layer 107*a*, the second skin layer 107*b* and the core layer 103 form a stack having a curved, in particular wavelike, extension. In other words, the membrane plate structure 100 comprises a curved, wavelike structure and runs not within a plane.

Figure 6:
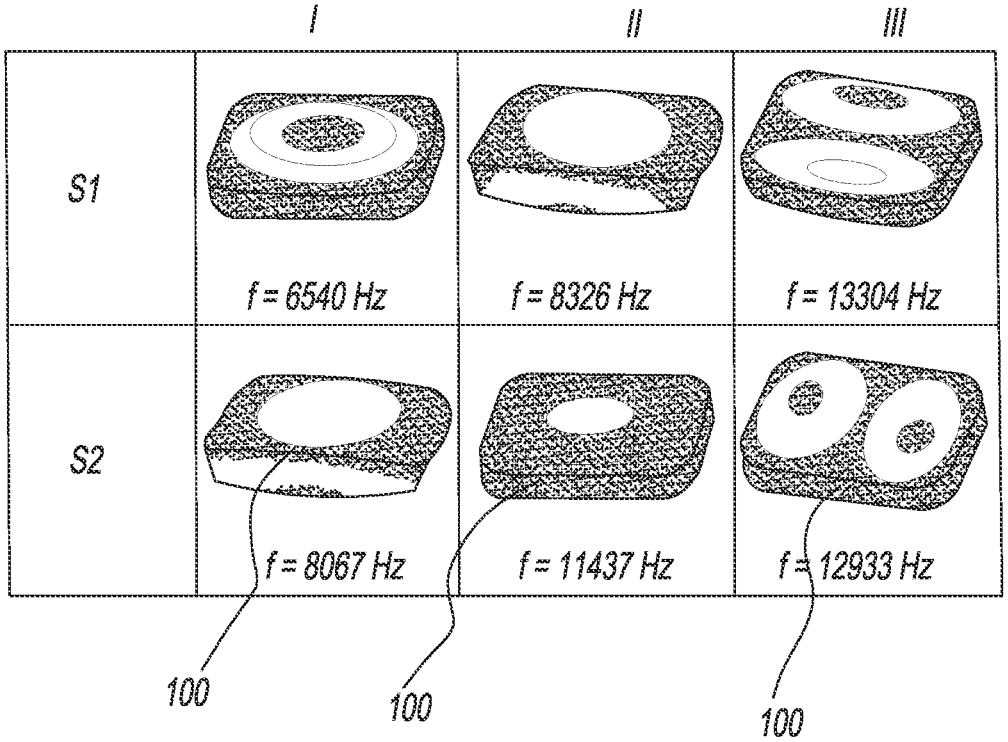
FIG. 6 shows the break-up modes simulations of the system membrane plate and coil.

FIG. 6 shows a simulation of a membrane plate 100 used in the simulation having a sandwich design with UD aramid fibers as skin layers 107*a*, 107*b* oriented along the longer (length) size of the membrane plate (S1) and oriented along the shorter size (width w) of the membrane plate (S2) according to the present invention. It is easy to understand that the first mode, i.e. the resonance frequency, in S1 is happening earlier than in S2, showing the beneficial effect of orienting the fibers along the shorter size of the membrane plate 100.

Figure 7:
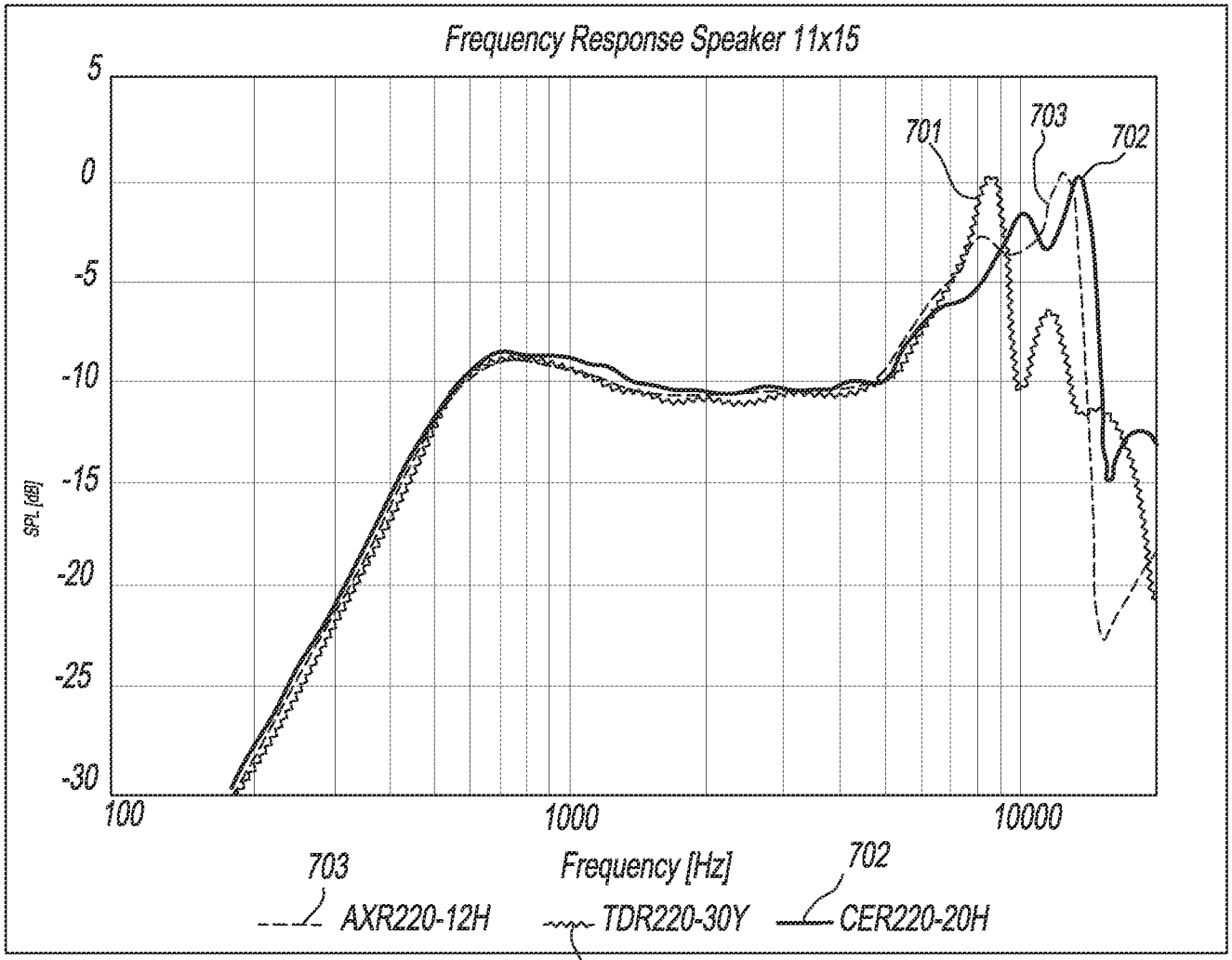
FIG. 7 shows a diagram illustrating sound pressure levels with respect to respective frequencies of three exemplary loudspeakers having different exemplary embodiments.

FIG. 7 shows a diagram illustrating sound pressure levels (SPL) with respect to respective frequencies of three exemplary loudspeakers. In the shown example in FIG. 7, three materials for a standard 11 mm×15 mm (millimeter) microspeaker have been used. All the materials have a total thickness of 220 μm (Micrometer) to properly compare the frequency response. Exemplary values for the exemplary materials are shown in Table 4 below:

TABLE 4

| | Thickness [μm] | Bending Modulus [Gpa] | Density [kg/m$^3$] | Area density [g/m$^2$] | Frequency Factor [m$^2$/s] |
|---|---|---|---|---|---|
| CIMERA TDR220-30Y (UD Aramid skin layers) | 220 | 24* | 650 | 143 | 1.33* |
| CIMERA CER220-20H (UD HM Carbon skin layers) | 220 | 71* | 510 | 112 | 2.61* |
| CIMERA AXR220-12H (Aluminum skin layers) | 220 | 18 | 620 | 135 | 1.21 |

*measured in fiber direction

Line 703 is indicative for a conventional loudspeaker made of a CIMERA AXR220-12H (AXR) material, wherein the loudspeaker comprises a sandwich material with 12 μm (Micrometer) of aluminum skin layer.

Line 701 is indicative for a loudspeaker according to the present invention made of CIMERA TDR220-30Y (TDR) material, wherein the loudspeaker comprises a sandwich material with 30 μm (Micrometer) aramid UD (Unidirectional) skin layers according to an exemplary embodiment of the present invention.

Line 702 is indicative for a loudspeaker according to the present invention made of CIMERA CER220-20H (CER), wherein the loudspeaker comprises a sandwich material with 20 μm (Micrometer) HM (High Modulus) Carbon UD (Unidirectional) skin according to an exemplary embodiment of the present invention.

A comparison of the mechanical properties of the three materials can be taken from table 4 above. As can be taken from the line 701, 702 presented in FIG. 7, TDR (CIMERA TDR220-30Y) in line 701 and AXR (CIMERA AXR220-12H) in line 703 presents very comparable mechanical and acoustic behavior, with the advantage that TDR is a non-conductive material. Instead, CER (CIMERA CER220-20H) in line 702 compared to AXR in line 703 is better performing in all the parameters with a higher break-up frequency and lower mass.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

LIST OF REFERENCE SIGNS

100 membrane plate
101 first skin layer
102 second skin layer
103 core layer
104 carrier element, membrane or surround
105 coil/vibrating element
106 fiber direction
107 fibers/UD fiber reinforced tape layer(s)
107*a* (top) skin layers layer
107*b* (bottom) skin layers layer
701 representative line for TDR
702 representative line for CER
703 representative line for AXR
w width
α angle

What is claimed is:

1. A membrane plate structure for generating sound waves, comprising:

a vibrating element;

a membrane plate coupled to the vibrating element for generating sound waves, wherein the membrane plate comprises a core layer, a first skin layer, and a second skin layer, and wherein the first skin layer and the second skin layer are located on opposing sides of the core layer;

wherein the first skin layer and the second skin layer each comprise a single layer of a unidirectional fiber reinforced polymer, wherein a width of the membrane plate is shorter than a length of the membrane plate, and wherein the fibers of the unidirectional fiber reinforced polymer are oriented along a fiber direction having an angle between −30° and +30°, with respect to an axis extending across the width of the membrane plate; and wherein a thickness of the membrane plate is less than 500 μm.

2. The membrane plate structure of claim 1, wherein a fiber direction of the first skin layer is parallel to a fiber direction of the second skin layer.

3. The membrane plate structure of claim 1, wherein the core layer comprises a material which is free of pores larger than 1 μm, and wherein the core layer is structured adhere to the first skin layer and the second skin layer.

4. The membrane plate structure of claim 1, wherein the core layer comprises a foam.

5. The membrane plate structure of claim 1, wherein the core layer further comprises a unidirectional fiber tape, having a fiber direction perpendicular to the fiber direction of the skin layers.

6. The membrane plate structure according to claim 1, wherein a heat deflection temperature of the membrane plate is higher than 180° C.

7. The membrane plate structure of claim 1, wherein the membrane plate structure maintains its geometrical dimensions within 5%, up to 220° C.

8. The membrane plate structure of claim 1, wherein the membrane plate comprises an area density less than 160 $g/m^2$.

9. The membrane plate structure of claim 1, wherein the unidirectional fiber reinforced polymer is non-conductive.

10. The membrane plate structure of claim 1, wherein the first skin layer and the second skin layer each comprise a unidirectional fiber reinforced polymer, and wherein the fiber reinforced polymer includes carbon based fibers.

11. The membrane plate structure of claim 1, wherein each of the first skin layer and the second skin layer have an area density less than 30 $g/m^2$.

12. The membrane plate structure of claim 1, wherein the membrane plate forms a flat, uncurved shape extending along the plane.

13. The membrane plate structure of claim 1, wherein the first skin layer, the second skin layer, and the core layer form a stack having a curved extension.

14. The membrane plate structure of claim 1, wherein the membrane plate includes a thickness which is less than 1/20 of a width of the membrane plate.

15. The membrane plate structure of claim 1, wherein the vibrating element and the membrane plate at least partially define a micro speaker.

16. A membrane plate structure for generating sound waves, comprising:

a vibrating element;

a membrane plate operably coupled to the vibrating element, wherein the membrane plate comprises:

a foam core layer sandwiched between a first skin layer and a second skin layer;

wherein the first skin layer and the second skin layer each comprise a unidirectional fiber tape;

wherein a thickness of the membrane plate is less than 500 μm; and wherein the membrane plate includes a width shorter than a length, wherein the first skin layer and the second skin layer further comprise a fiber reinforced polymer, and wherein a fiber direction of the first skin layer and the second skin layer are each oriented at an angle between −30° and +30° with respect to an axis extending across the width of the membrane plate.

17. The membrane plate structure of claim 16, wherein a fiber direction of the first skin layer is parallel to a fiber direction of the second skin layer, wherein the first skin layer and the second skin layer further comprise a fiber reinforced polymer.

18. The membrane plate structure of claim 17, wherein the core layer further comprises a foam.

* * * * *